US006443799B1

(12) United States Patent
Gibson

(10) Patent No.: US 6,443,799 B1
(45) Date of Patent: Sep. 3, 2002

(54) GYROSCOPIC DIVING TOY

(76) Inventor: Edward G. Gibson, 14620 Tomki Rd., Redwood Valley, CA (US) 95470

( * ) Notice: Subject to any disclaimer, the term of this patent is extended or adjusted under 35 U.S.C. 154(b) by 0 days.

(21) Appl. No.: 09/902,386

(22) Filed: Jul. 10, 2001

(51) Int. Cl.[7] ..... A63H 23/00
(52) U.S. Cl. ..... 446/158; 446/153; 446/156
(58) Field of Search ..... 446/153, 154, 446/155, 156, 158, 159, 236, 237, 238

(56) References Cited

U.S. PATENT DOCUMENTS 3,924,350 A * 12/1975 Hsu ..... 273/457
3,935,665 A * 2/1976 Tong ..... 446/158
4,241,535 A * 12/1980 Tsukuda ..... 446/156
4,342,174 A * 8/1982 Nikaido ..... 446/158
4,687,456 A * 8/1987 Wang ..... 446/158
5,077,929 A * 1/1992 Khan ..... 446/154
5,197,913 A * 3/1993 Suzuki ..... 446/156
5,344,357 A * 9/1994 Lyczek ..... 446/154
5,823,845 A * 10/1998 O'Berrigan ..... 446/234
5,865,662 A 2/1999 Dammann
6,093,076 A * 7/2000 Street ..... 446/156

* cited by examiner

*Primary Examiner*—Jacob K. Ackun
*Assistant Examiner*—Faye Francis
(74) *Attorney, Agent, or Firm*—Jack Lo

(57) ABSTRACT

A gyroscopic diving toy is comprised of a housing and a motor positioned inside the housing. A battery compartment is arranged adjacent the motor for receiving a battery. A swim bladder and a ballast are arranged inside the housing to provide neutral buoyancy and balance. A propeller is attached to an axle of the motor protruding through the housing. The axle of the motor is coaxial with a longitudinal spin axis of the housing. The housing is generally circular about the spin axis for minimizing drag when spinning. When the motor is activated, the housing is spun rapidly in a direction opposite to the rotation of the propeller, and gyroscopic forces generated by the rotation of the housing cause the toy to repeatedly dive and surface automatically for amusement.

10 Claims, 3 Drawing Sheets

GYROSCOPIC DIVING TOY

BACKGROUND OF THE INVENTION

1. Field of the Invention

This invention relates generally to motorized swimming toys.

2. Prior Art

Motorized toy boats and swimming toys are generally limited to two-dimensional movements along the surface of the water. Although some toy submarines can dive and move about in three dimensions, they require sophisticated diving controls that make them relatively large and expensive. They are also limited to slow and boring motions. Many toy boats have been powered by a popular torpedo-shaped outboard motor which is suspended below the boats. Although the outboard motor can be detached from the boat, it cannot swim or run in the water by itself without using the boat for floatation.

OBJECTIVES OF THE INVENTION

The objectives of the present gyroscopic diving toy are:

to spin continuously;

to repeatedly dive and surface automatically; and to rapidly move about in three dimensions for amusement.

Further objectives of the present invention will become apparent from a consideration of the drawings and ensuing description.

BRIEF SUMMARY OF THE INVENTION

A gyroscopic diving toy is comprised of a housing and a motor positioned inside the housing. A battery compartment is arranged adjacent the motor for receiving a battery. A swim bladder and a ballast are arranged inside the housing to provide neutral buoyancy and balance. A propeller is attached to an axle of the motor protruding through the housing. The axle of the motor is coaxial with a longitudinal spin axis of the housing. The housing is generally circular about the spin axis for minimizing drag when spinning. When the motor is activated, the housing is spun rapidly in a direction opposite to the rotation of the propeller, and gyroscopic forces generated by the spin of the housing cause the toy to repeatedly dive and surface automatically for amusement.

DRAWING REFERENCE NUMERALS

10. Housing
11. Front Portion
12. Rear Portion
13. Spin Axis
14. Front End
15. Rear End
16. Propeller
17. Fin
18. Motor
19. First Terminal

20. Second Terminal
21. Motor Mount
22. Battery Compartment
23. Conductor
24. Ballast Mount
25. Battery
26. First Pole
27. Second Pole
28. Spring
29. Swim Bladder
30. Ballast
31. Center of Gravity
32. Flat Portion
33. Flat Portion
34. Axle

DETAILED DESCRIPTION OF THE INVENTION

FIG. 1

Figure 1:
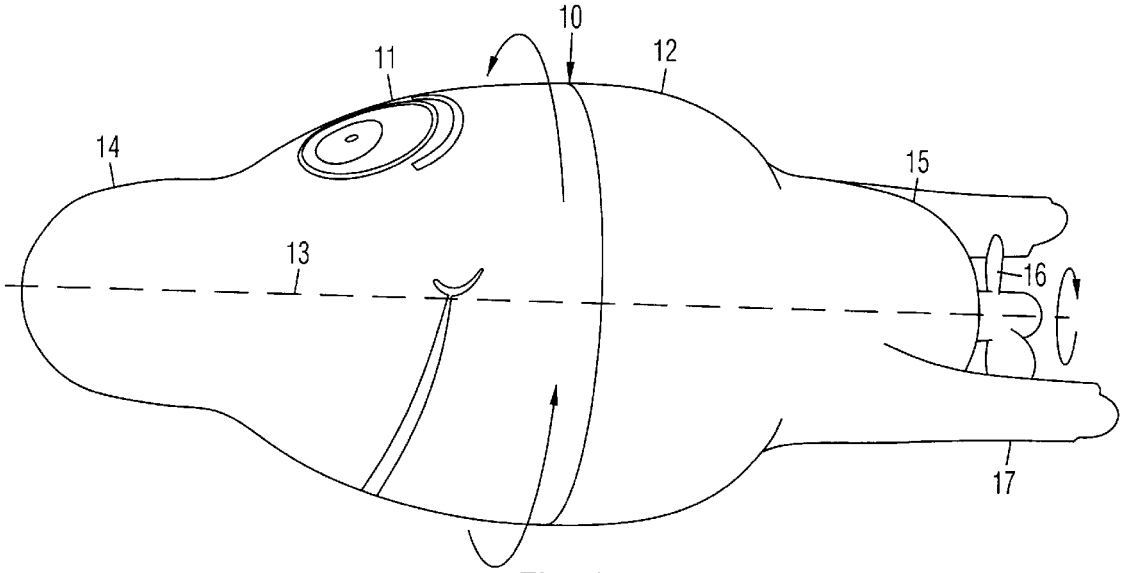
FIG. 1 is a side perspective view of the present gyroscopic diving toy.

A preferred embodiment of the present gyroscopic diving toy is shown in a side perspective view in FIG. 1. It is comprised of a housing 10 with a front portion 11 which is detachably connected to a rear portion 12. Housing 10 is elongated along a spin axis 13. Housing 10 has a rounded front end 14 and a tapered rear end 15 for reduced drag when moving in a forward direction, and is rounded about spin axis 13 for reduced drag when spinning about axis 13. A propeller 16 is attached to rear end 15 along axis 13. Propeller 16 is arranged to spin in a predetermined direction and cause housing 10 to spin in an opposite direction. The indicated spin directions are only exemplary. A pair of fins 17 protrude longitudinally from rear end 15 on either side of propeller 16 to help prevent a person's fingers from touching propeller 16, and to improve directional stability. The surfaces of fins 17 are generally parallel to the direction of spin for reducing drag when housing 10 is spinning. Housing 10 is preferably devoid of any surfaces or projections which are perpendicular to the spin direction for maximizing spin rate. Alternatively, housing 10 may be of another shape, such as an animal figure, a human figure, a cartoon figure, a submarine, a rocket, a torpedo, etc. Also, propeller 16 may be attached to front end 14 instead.

FIG. 2

Figure 2:
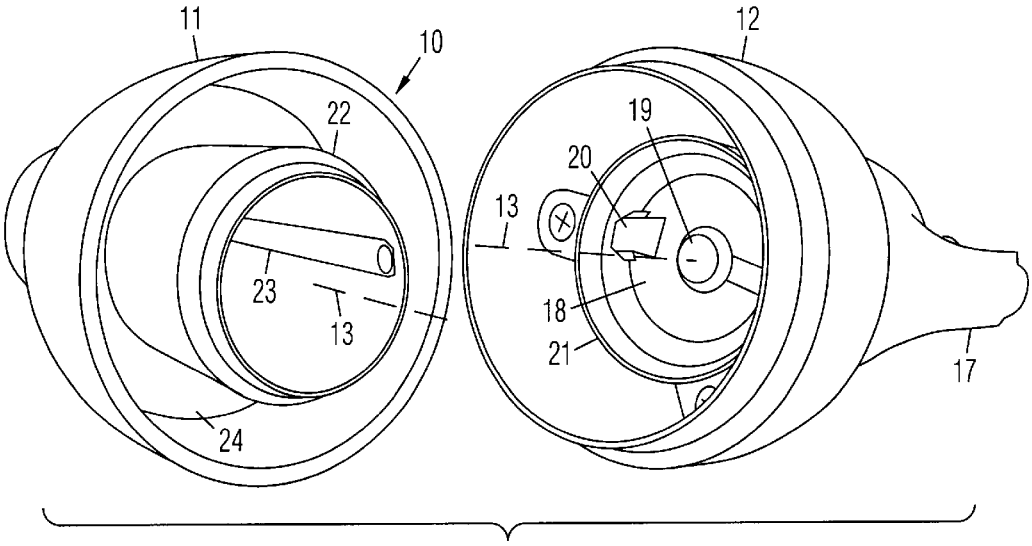
FIG. 2 is an exploded view thereof.

Front portion 11 and rear portion 12 of housing 10 are shown separated in FIG. 2. An electric motor 18 with a first terminal 19 and a second terminal 20 is secured in a motor mount 21 which is attached inside rear portion 12 of housing 10. Motor 18 is axially aligned with spin axis 13 of housing 10. An elongated battery compartment 22 is attached inside front portion 11 of housing 10 for receiving a battery, such as an "AA" cell (not shown), and is also aligned with spin axis 13 of housing 10. A conductor 23 is arranged inside battery compartment 22 for making contact with terminal 20 on motor 18. An annular ballast mount 24 is positioned around battery compartment 22.

FIG. 3

Figure 3:
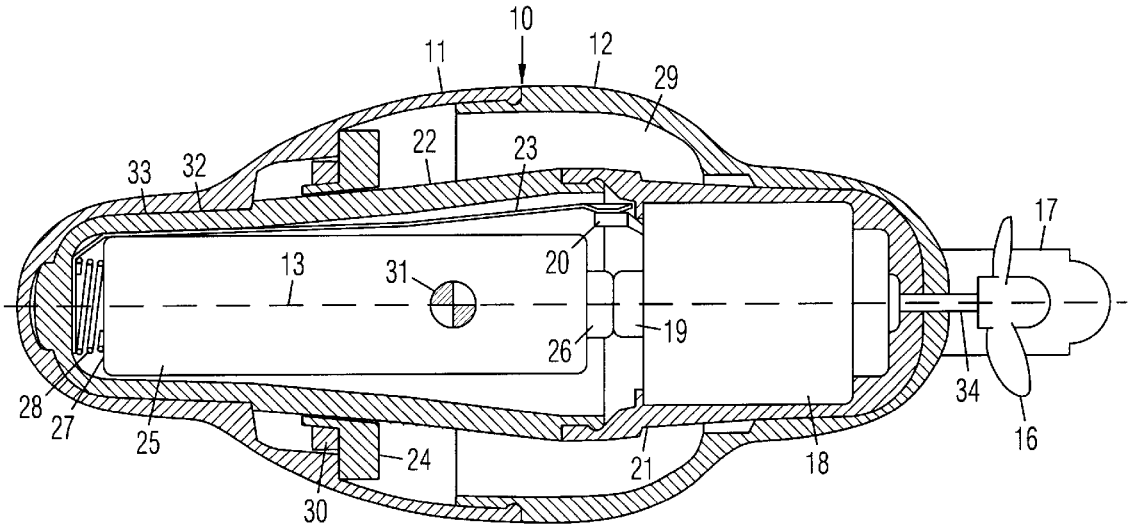
FIG. 3 is a side sectional view thereof.

The assembled diving toy is shown in a sectional view in FIG. 3. Front portion 11 of housing 10 is mated to and sealed against rear portion 12 for waterproofing, but front portion 11 is rotatable relative to rear portion 12. Battery compartment 22 is mated to and sealed against motor mount 21 for waterproofing, but battery compartment 22 is also rotatable relative to motor mount 21. A battery 25 is positioned in battery compartment 22 with a first pole 26 against terminal 19 of motor 18, and a second pole 27 against a spring 28 connected to an inner end of conductor 23. A swim bladder 29 is provided inside housing 10 around battery compartment 22 and motor mount 21. Swim bladder 29 may be comprised of a hollow air pocket or a solid floatation material, such as polystyrene foam. A metal annular ballast 30 is positioned around ballast mount 24, which is secured inside front portion 11 of housing 10. In combination with battery 25, ballast 30 is arranged to position a center of gravity 31 of the toy slightly ahead of a volumetric center of housing 10. Center of gravity 31 is positioned along spin axis 13. In combination with battery 25, ballast 30 and swim bladder 29 are arranged to provide neutral buoyancy at a predetermined depth, that is, the toy is arranged to be suspended in water at the buoyancy depth when motor 18 is deactivated. Ballast 30 may be eliminated by suitably sizing swim bladder 29 for the desired buoyancy. Resilient seals (not shown) are provided at all joints for waterproofing.

Battery compartment 22 has flat portions 32 which are keyed to flat portions 33 inside front portion 11 of housing 10. When front portion 11 is rotated about axis 13 relative to rear portion 12, battery compartment 22 is also rotated relative to motor 18. Motor 18 is activated when conductor 23 is rotated into engagement with terminal 20, and deactivated when conductor 23 is rotated away from terminal 20. Propeller 16 is attached to an axle 34 of motor 18 protruding through housing 10. Axle 34 is coaxial with spin axis 13 of housing 10.

Alternatively, battery compartment 22 may be integral with front portion 11 of housing 10, and motor mount 21 may be integral with rear portion 12 of housing 10. Instead of providing a separable housing for battery installation, a battery cover may be provided. Also, another arrangement for activating the motor may be provided.

FIG. 4

Figure 4:
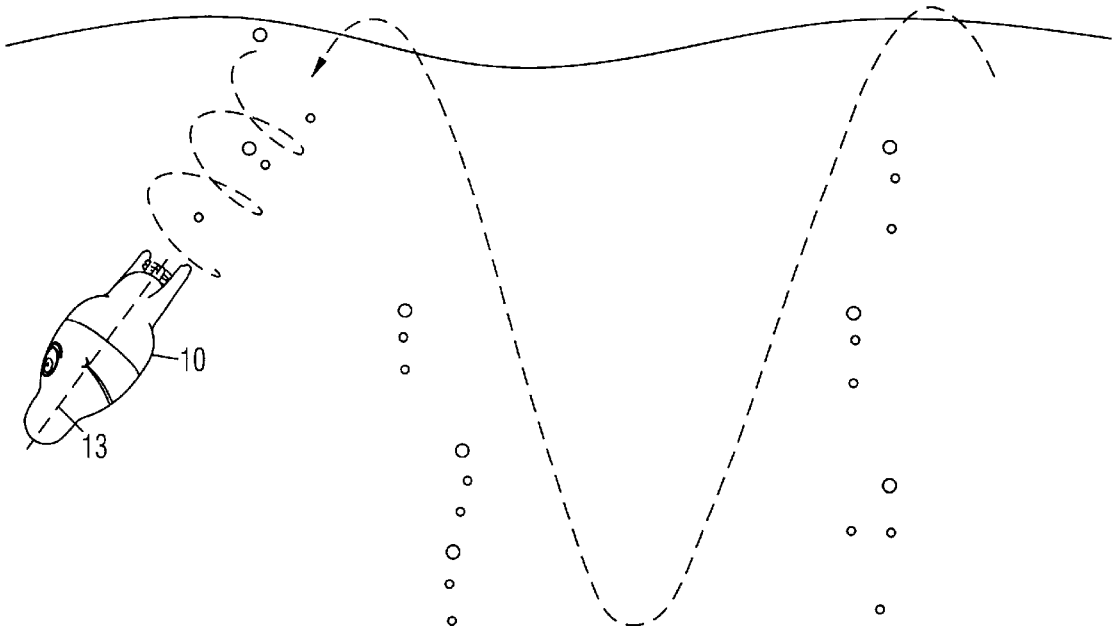
FIG. 4 is a side view thereof in action.

The diving toy is shown in action under water in FIG. 4. When the motor is activated, housing 10 is caused to spin rapidly about axis 13 in a direction opposite to the rotation of the propeller. Gyroscopic forces generated by the spin of housing 10 cause the toy to repeatedly dive and surface automatically for amusement. The maximum diving depth is directly proportional to the buoyancy depth.

SUMMARY AND SCOPE

Accordingly, the present gyroscopic diving toy is arranged to spin about its own axis, repeatedly dive and surface automatically, and rapidly move about in three dimensions for amusement.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A gyroscopic diving toy, comprising:

a housing arranged to spin about a spin axis in a first direction;

a battery compartment in said housing for receiving a battery;

an electric motor in said housing arranged to spin in a second direction opposite to said first direction;

a propeller attached to said motor coaxial with said spin axis and arranged to spin in said second direction;

a swim bladder in said housing for providing neutral buoyancy at a predetermined depth under water when said battery is received in said battery compartment;

wherein when said motor is activated, said housing is caused by the spin of said motor and said propeller to spin about said spin axis in said first direction, said housing is also caused to repeatedly dive and surface automatically by gyroscopic forces generated by the spin of said housing.

2. The gyroscopic diving toy of claim 1, wherein said housing is substantially devoid of any surface which is generally perpendicular to the spin direction of said housing for maximizing spin rate.

3. The gyroscopic diving toy of claim 1, further including a ballast inside said housing for adjusting buoyancy and balance.

4. The gyroscopic diving toy of claim 1, further including a pair of fins protruding longitudinally from said housing on either side of said propeller, wherein surfaces of said fins are generally parallel to said first direction of spin for reducing drag.

5. A gyroscopic diving toy, comprising:

a housing arranged to spin about a spin axis in a first direction, wherein said housing is rounded about said spin axis for reducing drag when spinning;

a battery compartment in said housing coaxial with said spin axis for receiving a battery;

an electric motor in said housing coaxial with said spin axis and arranged to spin in a second direction opposite to said first direction;

a propeller attached to said motor coaxial with said spin axis and arranged to spin in said second direction;

a swim bladder in said housing coaxial with said spin axis for providing neutral buoyancy at a predetermined depth under water when said battery is received in said battery compartment;

wherein when said motor is activated, said housing is caused by the spin of said motor and said propeller to spin about said spin axis in said first direction, said housing is also caused to repeatedly dive and surface automatically by gyroscopic forces generated by the spin of said housing.

6. The gyroscopic diving toy of claim 5, wherein said housing is substantially devoid of any surface which is generally perpendicular to the spin direction of said housing for maximizing spin rate.

7. The gyroscopic diving toy of claim 5, further including a ballast in said housing coaxial with said spin axis for adjusting buoyancy and balance.

8. The gyroscopic diving toy of claim 5, further including a pair of fins protruding longitudinally from said housing on either side of said propeller, wherein surfaces of said fins are generally parallel to said first direction of spin for reduced drag.

9. A gyroscopic diving toy, comprising:

a housing arranged to spin about a spin axis in a first direction, wherein said housing is elongated along said spin axis for directional stability, and rounded about said spin axis for reducing drag when spinning;

a battery compartment in said housing coaxial with said spin axis for receiving a battery;

an electric motor in said housing coaxial with said spin axis and arranged to spin in a second direction opposite to said first direction;

a propeller attached to said motor generally coaxial with said spin axis and arranged to spin in said second direction;

a pair of fins protruding longitudinally from said housing on either side of said propeller, wherein surfaces of said fins are generally parallel to said first direction of spin for reducing drag;

an annular swim bladder in said housing coaxial with said spin axis for providing neutral buoyancy at a predetermined depth under water when said battery is received in said battery compartment;

an annular ballast in said housing coaxial with said spin axis for adjusting buoyancy and balance;

wherein when said motor is activated, said housing is caused by the spin of said motor and said propeller to spin about said spin axis in said first direction, said housing is also caused to repeatedly dive and surface automatically by gyroscopic forces generated by the spin of said housing.

10. The gyroscopic diving toy of claim 9, wherein said housing is substantially devoid of any surface which is generally perpendicular to the spin direction of said housing for maximizing spin rate.

* * * * *